United States Patent [19]

Asari

[11] 4,365,497

[45] Dec. 28, 1982

[54] INTERMEDIATE FRAME TYPE INDIRECT EXTRUSION PRESS

[75] Inventor: Akira Asari, Osaka, Japan

[73] Assignee: Kobe Steel, Ltd., Kobe, Japan

[21] Appl. No.: 946,330

[22] Filed: Sep. 27, 1978

[30] Foreign Application Priority Data

| | | | |
|---|---|---|---|
| Oct. 7, 1977 | [JP] | Japan | 52/122663 |
| Oct. 7, 1977 | [JP] | Japan | 52/122664 |
| Oct. 7, 1977 | [JP] | Japan | 52/122665 |
| Oct. 7, 1977 | [JP] | Japan | 52/122666 |

[51] Int. Cl.[3] ..... B21C 27/00; B21C 33/00; B21C 35/04

[52] U.S. Cl. ..... 72/255; 72/263; 72/265; 72/273.5

[58] Field of Search ..... 72/253, 273.5, 255, 72/263, 264, 265

[56] References Cited

U.S. PATENT DOCUMENTS

| | | | |
|---|---|---|---|
| 2,753,043 | 7/1956 | Poleschuk | 72/255 |
| 3,143,211 | 8/1964 | Krause et al. | 72/263 |
| 3,184,944 | 5/1965 | Sibler | 72/255 |
| 3,431,765 | 3/1969 | Lombard | 72/255 |
| 3,522,721 | 8/1970 | Whiting | 72/255 |
| 3,563,079 | 2/1971 | Monie et al. | 72/255 |
| 3,738,144 | 6/1973 | Doudet | 72/255 |
| 3,827,273 | 8/1974 | Kishino et al. | 72/255 |
| 4,103,529 | 8/1978 | Huertgen | 72/253 A |

*Primary Examiner*—Lowell A. Larson

*Attorney, Agent, or Firm*—Oblon, Fisher, Spivak, McClelland & Maier

[57] ABSTRACT

In an indirect extrusion press of the type wherein a die stem is connected to a press axis on the rear end surface of a press platen and extends towards a container, an intermediate frame type indirect extrusion press including an intermediate frame movably interposed between the press platen and the container in the direction of the press axis, encompassing the die stem and equipped with a guide section in its longitudinal direction, a driving device for moving the intermediate frame in the direction of the press axis and a guide mechanism placed between the intermediate frame and press structures such as a press bed, a column and the like and guiding the intermediate frame in the direction parallel to the direction of the press axis.

6 Claims, 18 Drawing Figures

INTERMEDIATE FRAME TYPE INDIRECT EXTRUSION PRESS

BACKGROUND OF THE INVENTION

1. Field of the Invention

This invention relates to an indirect extrusion press and more particularly to an intermediate frame type indirect extrusion press.

2. Description of the Prior Art

A die stem in an indirect extrusion press usually has a cylindrical shape. In an indirect extrusion press of such a type wherein this stem is not capable of being disposed in and out of the direction of the press axis via a press platen, when a storing total press capacity is applied as a load in the axial direction of the die stem, a large bending moment occurs by even a slight eccentric quantity even if the die stem is suitably secured to the rear end portion of the press platen. It is necessary, but is difficult, to sufficiently cope with this bending moment. Hence, the accuracy of the die stem can not be maintained and in addition, the die stem is sometimes damaged. A large bending moment also acts on the die stem due to a shear force when a product is cut off from a discard after completion of the extrusion. As a result, core deviation of the die stem and breakage at the time of fitting occur, thus failing to extrude a product having an intended dimension.

To meet with the problem, research and development of various aparatuses has been made including a die stem back-up device such as disclosed by the inventor of this invention in Japanese Utility Model Laid-Open No. 110,382/1974, for example. However, none of them has yet been entirely satisfactory.

As a conclusion based on vast knowledges and versatile experiences in using press apparatuses and also as a result of subsequent research and development, the inventor of the present invention has now succeeded in developing a press apparatus having various additional features without sacrificing those of the prior press apparatus.

SUMMARY OF THE INVENTION

The first object of the present invention is to provide an indirect extrusion press of simplified construction which ensures retaining accuracy of a die stem even when the total press capacity is applied as a load to the die stem in its axial direction and can hold the die stem at a correct position against the moment of a shear force acting thereon at the time of cut-off of a product from a discard without causing core deviation, deformation and damage.

The second object of the present invention is to provide an indirect extrusion press which enables easy replacement of tools required for the extrusion outside the press and which calls for only a single shearing device for cutting off the portion to be product from the discarded after completion of extrusion.

The third object of the present invention is to provide an indirect extrusion press which completely prevents core deviation of an elongated cylindrical die stem provided in conjunction with the core of the press axis to thereby ensure the maintenance of accuracy, protects the die stem from deformation and damages due to the shear force at the time of cut-off of the product from the discard and guarantees necessary accuracy and sufficient back-up function.

The fourth object of the present invention is to provide an indirect extrusion press which markedly facilitates withdrawal of a stuffed billet.

In order to accomplish these and other objects, the first embodiment of the present invention provides, in an indirect extrusion press of the type wherein a die stem is connected to a press axis on the rear end surface of a press platen and extends towards a container, an intermediate frame type indirect extrusion press which comprises an intermediate frame interposed movably in the direction of the press axis between said press platen and said container, encompassing said die stem and equipped with a guide section in its longitudinal direction; a driving device for moving said intermediate frame in the direction of the press axis; and guide means placed between said intermediate frame and press structures such as a press bed, a column and the like and guiding said intermediate frame in the direction parallel to the direction of the press axis.

The second embodiment of the present invention pertains, in an indirect extrusion press of the type wherein a die stem is connected to a press axis on the rear end surface of a press platen and extends towards a container, to an intermediate frame type indirect extrusion press which comprises an intermediate frame movably interposed in the direction of the press axis between the press platen and the container, encompassing said die stem and equipped with a guide section in its longitudinal direction; a driving device for moving the intermediate frame in the direction of the press axis; guide means placed between the intermediate frame and press structures such as a press bed, a column and the like and guiding the intermediate frame in the direction parallel to the direction of the press axis; a shearing device disposed retractably in the direction at a right angle to the direction of the press axis for the purpose of cutting off a product from a discard; and a stopper disposed on the intermediate frame on the side toward the container to define a gap for entrance of a shear thereinto between the intermediate frame and the container.

A third embodiment provides an indirect extrusion press which comprises a die stem guide member secured onto the rear end surface of the press platen and having a guide section in the direction at a right angle to the press direction; a die stem fitted movably or securably to the guide member and connected to the press center of the press platen via a die stem clamp; driving means for releasing the clamp of the die stem and moving the die stem between the press center and the outside of the press; a shearing device furnished to said intermediate frame and capable of moving in the direction at a right angle to the press direction; a moving frame movably disposed in the direction at a right angle to the press direction to the intermediate frame and equipped with a detachable die stem guide ring; and driving means for moving the moving frame in the direction at a right angle to the press direction between the press center and the outside of said press.

The fourth embodiment of the present invention provides an intermediate frame type indirect extrusion press which comprises a shearing device disposed at the back of the press platen for the purpose of cutting an extruded product from a portion to be discarded; an intermediate frame having a guide ring for retaining the outer circumference of the die stem at the back of the press platen; and a die stem guide device constructed in such a fashion as to allow the intermediate frame and the die stem to move relatively in the press direction, to retain the central portion in the longitudinal direction of the die stem at the guide ring of the intermediate frame during extrusion and to retain the rear end portion of the die stem by means of said guide ring of the intermediate frame during cutoff of the portion to be discarded.

A fifth embodiment provides an intermediate frame type indirect extrusion press which comprises a die stem slide guide disposed on the rear end surface of the press platen and equipped with a slide surface in the direction at a right angle to the press center; a die stem connected to the guide via a die stem guide, a die stem backer and the like; die-stem driving means for moving or securing the die stem between the press center and a position spaced apart therefrom; a trough disposed retractably to and from the press center when the die stem moves outside the press; and a stuffed billet treating device causing the front surface of the intermediate frame to abut the rear surface of the die stem slide guide when a billet is stuffed into the container while the trough is in a waiting condition at the press center and allowing the billet stuffed in the container to protrude onto the trough by means of the capacity of a main ram.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein:

FIGS. 7 through 12 show the press cycle of the press shown in FIG. 1 wherein FIG. 7 is a sectional view of the supply step of a billet; FIG. 8 is a sectional view of the insertion step of the billet; FIG. 9 is a sectional view of billet upset- and billet piercing steps; FIG. 10 is a sectional view of the extrusion step; FIG. 11 is a sectional view after completion of the extrusion; and FIG. 12 is a sectional view of discard protruding and shearing steps;

FIGS. 13 and 14 show the replacement operation cycle wherein FIG. 13 is a sectional view of the billet supply step and FIG. 14 is a sectional view of the billet insertion step;

DETAILED DESCRIPTION OF THE PREFERRED EMBODIMENTS

Figure 1:
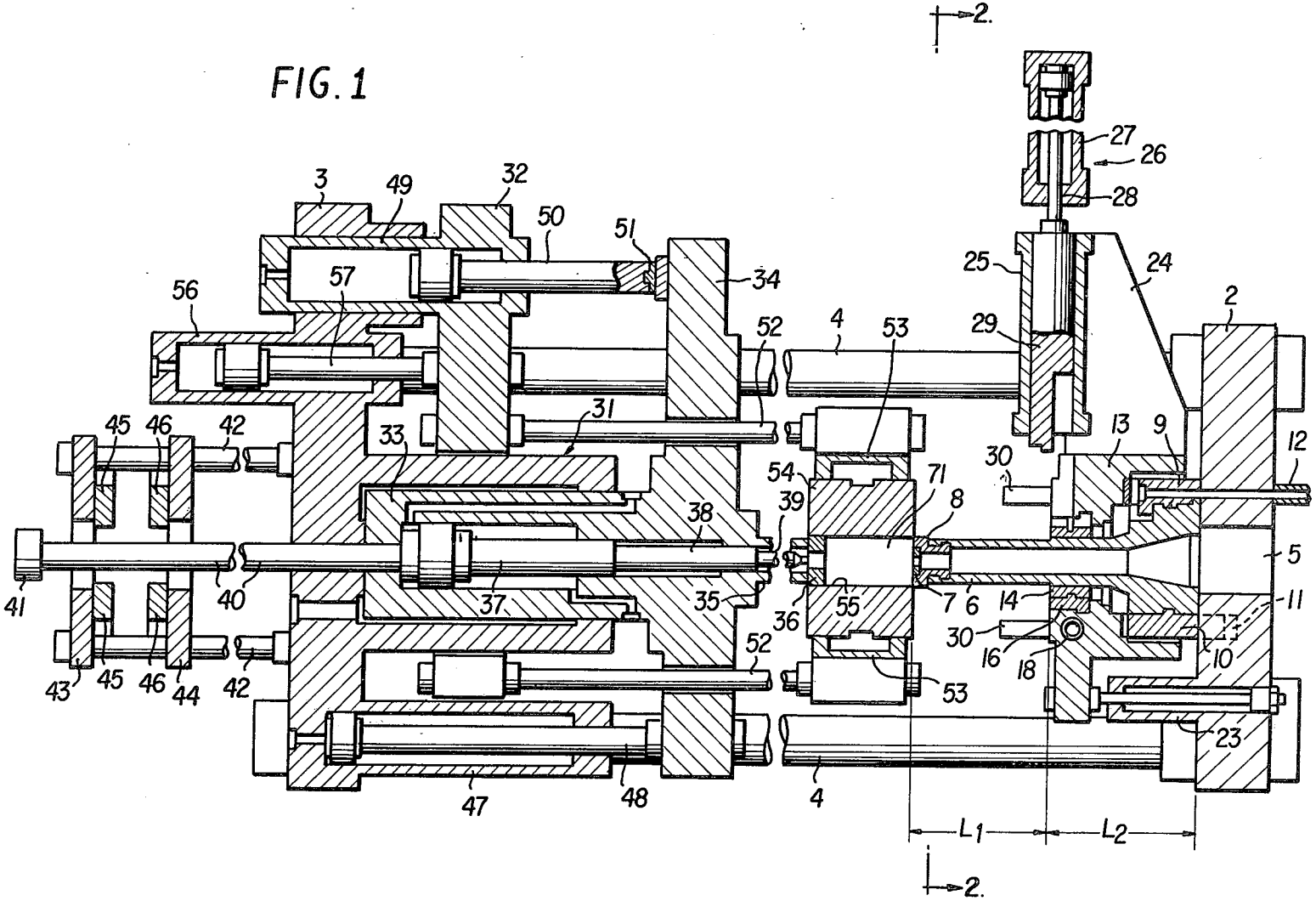
FIG. 1 is a side sectional view of the indirect extrusion press of the present invention.
Figure 2:
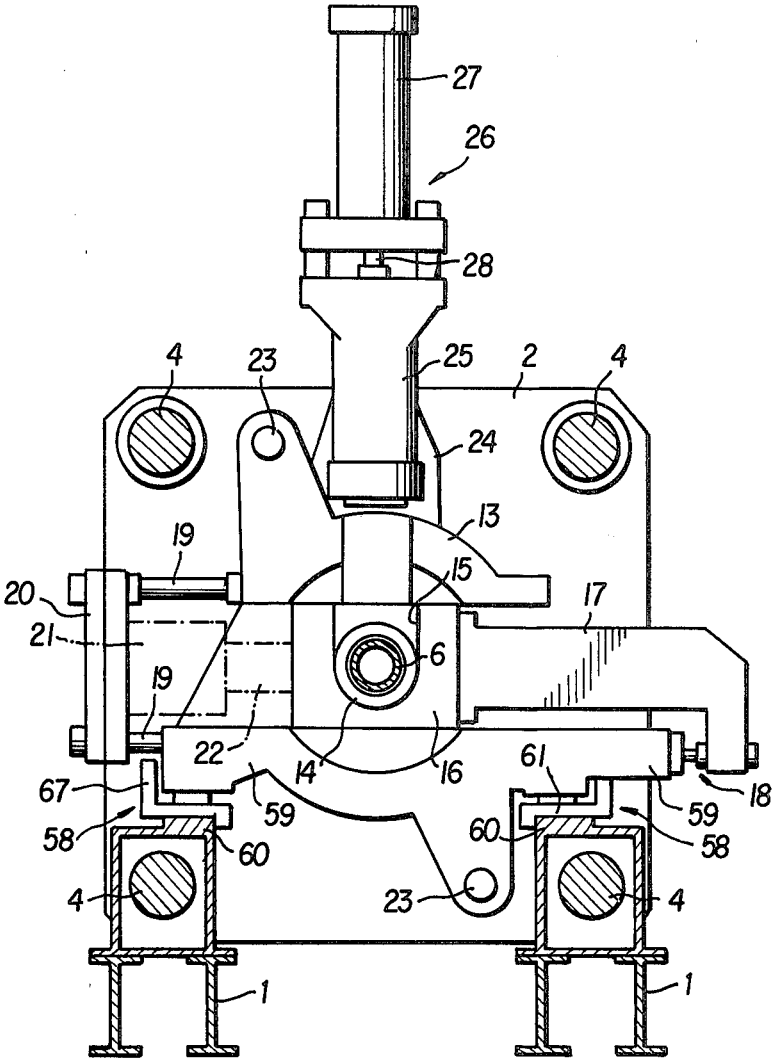
FIG. 2 is a sectional view taken along line II—II of FIG. 1.

Preferred embodiments of the present invention will now be explained in detail with reference to the accompanying drawings. In FIGS. 1 and 2, which are a side sectional view and a longitudinal sectional view of the press apparatus of the invention, reference numeral 1 represents a base frame installed in a pit, 2 denotes a press platen and 3 denotes a main cylinder frame. In these drawings the extruding direction is to the right side and explanation will be given with this direction being as the forward direction and the opposite direction as the rear direction. Namely, the press platen 2 is disposed at the forward position of the base frame 1 and the main cylinder frame 3 at its rear position so as to oppose and spaced apart from each other. Both press platen 2 and main cylinder frame 3 are strongly secured by a plurality of columns 4 in a diagonal arrangement. Thus, the press structure has a rigid frame structure.

A through-hole 5 is bored on the core of the press axis of the press platen 2.

Reference numeral 6 designates a cylindrical die stem of which base portion is secured onto the rear end surface of the press platen 2 with its axis being concentrical with the axis of the press platen 2. This die stem extends towards the main cylinder frame 3. A die 7 for determining the outer dimension of a product is furnished with respect to the die stem 6. In the embodiment shown, die 7 is connected via a die holder 8.

Reference numeral 9 represents a stem bell clamp and 10 denotes a die stem slide that are respectively fitted into the root section of the die stem 6 via a stepped structure. Reference numeral 11 represents a hydraulic jack which is incorporated in the press platen 2 and is capable of applying hydraulic jack force to the stem bell clamp 9.

Reference numeral 12 designates a tension bolt which fastens the stem bell clamp 9 and the press platen 2 and strongly secures the die stem 6 to the press platen 2 in cooperation with the abovementioned hydraulic jack 11.

Reference numeral 13 represents an intermediate frame which is interposed between the press platen and a container, is capable of moving in the direction of the press axis and encompasses the die stem 6. A die stem guide ring 14, positioned on the rear end surface of the intermediate frame 13, is fitted to the die stem 6 and guides the intermediate frame 13 in the longitudinal direction of the die stem 6. In the embodiment described, this die stem guide ring 14 is connected to a die stem guide 16 having a U-shaped fitting section 15 as specifically illustrated in FIG. 2.

The guide ring 14 and the stem guide 16 are fitted to each other by means of a stepped structure and the stem guide 16 and the intermediate frame 13 are also fitted to each other by means of a stepped structure. As depicted specifically in FIG. 2, the die stem guide 16 is incorporated in the intermediate frame 13 and is allowed to move freely in the direction crossing at right angles to the press axis. In FIG. 2, reference numeral 17 designates a slide frame which extends outwardly from the stem guide 16. A cylinder device 18 is disposed between this slide frame 17 and the intermediate frame 13 and functions as a driving device for the movement of the stem guide 16.

The die stem guide 16 can be used as a slide shear holder for cutting off a portion to be discarded from the product after completion of extrusion. For this purpose, a tie rod 19 is provided to extend from the intermediate frame 13 on the opposite side of the cylinder device 18 for fitting of a cylinder base 20, and a cylinder 21 is provided to this base 20 and a piston ram 22 is fitted in the sliding direction of the stem guide 16.

Reference numeral 23 represents a cylinder device as a driving device for moving the intermediate frame 13. The cylinder device 23 is retractable in the extruding direction between the intermediate frame 13 and the press platen 2.

Reference numeral 24 represents a shear mounting which is fitted to the intermediate frame 13 and a shear guide cylinder 25 is fitted to cross perpendicularly the press axis. Reference numeral 26 represents a vertical shearing device which comprises a shear cylinder 27 and a shear piston 28 whereby a shear 29 is secured to the piston end. The shear 29 is capable of moving along the axis of the shear guide cylinder 25 and is caused to move in a perpendicular direction with respect to the press axis in sliding contact with the rear end surface of the intermediate frame 13. Reference numeral 30 designates a stopper which protrudes from the rear end surface of the intermediate frame 13 towards the container. In cutting the product off from the portion to be discarded by the shear 29, the rear end surface of the stopper 30 strikes the forward end surface of the container and thereby defines a gap required for penetration of the shear 29.

Reference numeral 31 designates a main cylinder fitted to the cylinder frame 3. A main ram 33 serving as the core of the press axis is fitted to the main cylinder 31 and is capable of moving in the direction of the press axis.

Reference numeral 34 designates a cross head which is formed integrally with the main ram 33, and a pressing stem 35 is formed integrally on the press core axis of the cross head to protrude forwardly. In the embodiment described, the inside of the main ram 33 is formed as a mandrel cylinder, into which is inserted a mandrel piston 37. The core axis of the piston 37 is substantially in conformity with the core axis of the press.

A mandrel 39 extends forwardly from the mandrel piston 37 via a mandrel holder 38 on the core axis of the press and is inserted into the pressing stem 35. Reference numeral 40 represents a tail rod extending rearwardly from the mandrel piston 37 passing through the main cylinder frame 3 and has at the end of its extension a tail end 41 as a block.

Reference numeral 42 designates a tie rod. A plurality tie rods extend rearward from the main cylinder frame 3, and a pair of stopper plates 43, 44 are connected to the tie rod 42 opposed and spaced apart from each other. Stoppers 45, 46 for the tail end 41 are turnably fitted to these stopper plates 43, 44, respectively.

Reference numeral 47 represents a slide cylinder which is formed to protrude from the main cylinder frame 3 towards the cross head 34 and the end of its cylinder piston 48 is secured to the cross head 34.

Reference numeral 49 represents a hydraulic coupling cylinder which is inserted into the main cylinder frame 3 from the rear frame 32 in the embodiment shown, and the end 51 of a piston 50 fitted to this cylinder 49 abuts with the rear end surface of the cross head 34. Incidentally, the rear frame 32 is interposed between the main cylinder frame 3 and the cross head 34, encompasses the main cylinder 31 and is guided on the press bed in the direction of the press axis.

Reference numeral 52 represents a container tie rod. In the embodiment shown, a plurality of tie rods 52 extend forwardly from the rear frame 32 and penetrate through the cross head 34, to which end is secured a container holder 53. A container 54 is connected to this holder 53. The container 54 has a billet-storing chamber 55 on the core axis of the press. The end of a piston 57 of a container-moving cylinder 56 provided to the main cylinder frame 3 is secured to the rear frame 32, thereby allowing retractable motion of the rear frame 32 and the container 54 forming the rigid frame structure in the direction of the press axis.

Figure 4:
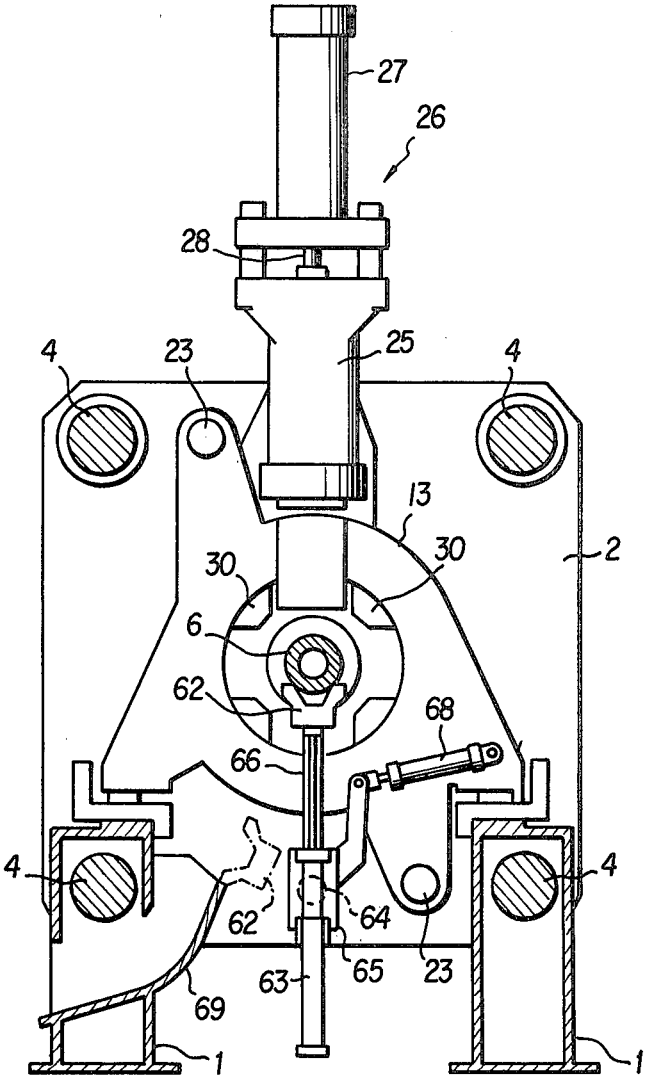
FIG. 4 is a sectional view taken along line IV—IV of FIG. 3.
Figure 5:
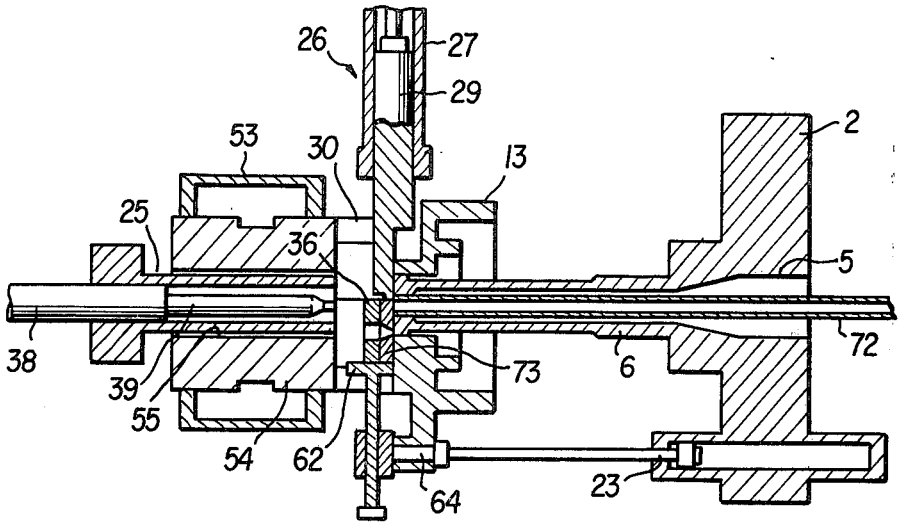
FIG. 5 is a sectional view of a vertical shearing device.
Figure 6:
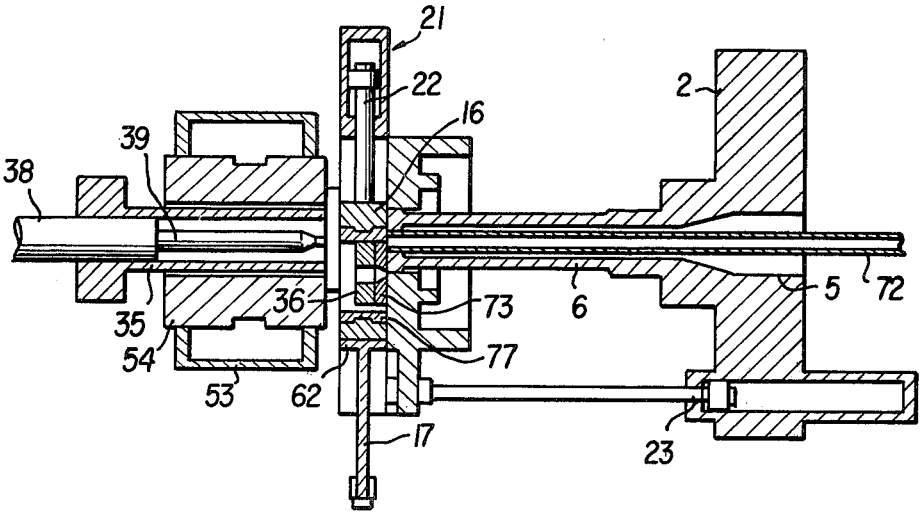
FIG. 6 is a sectional view of a slide shearing device.

Incidentally, the intermediate frame 13 is caused to move rearwardly and to reciprocate by driving device 23. Guide means 58 for such reciprocable motion is interposed between the bed as the press structure and an arm 59 extending from the intermediate frame 13 as shown in FIGS. 2 and 4. In these drawings a pair of right and left liners 60 are shown disposed on the bed 1 in parallel with the direction of the press axis and slide shoes 61 provided to the arms 59 are brought into frictional contact with the pair of liners 60. Furthermore, the abovementioned guide means 58 represents an example of the present invention and can be adapted to other portions of the press structure. For example, since the press platen 2 and the main cylinder frame 3 are firmly connected by a plurality of columns 4 in the rigid frame structure, the guide means 58 may be interposed between the columns 4 and the arms 59. In addition, the guide means 58 may be connected to both the columns 4 and the bed 1.

Figure 3:
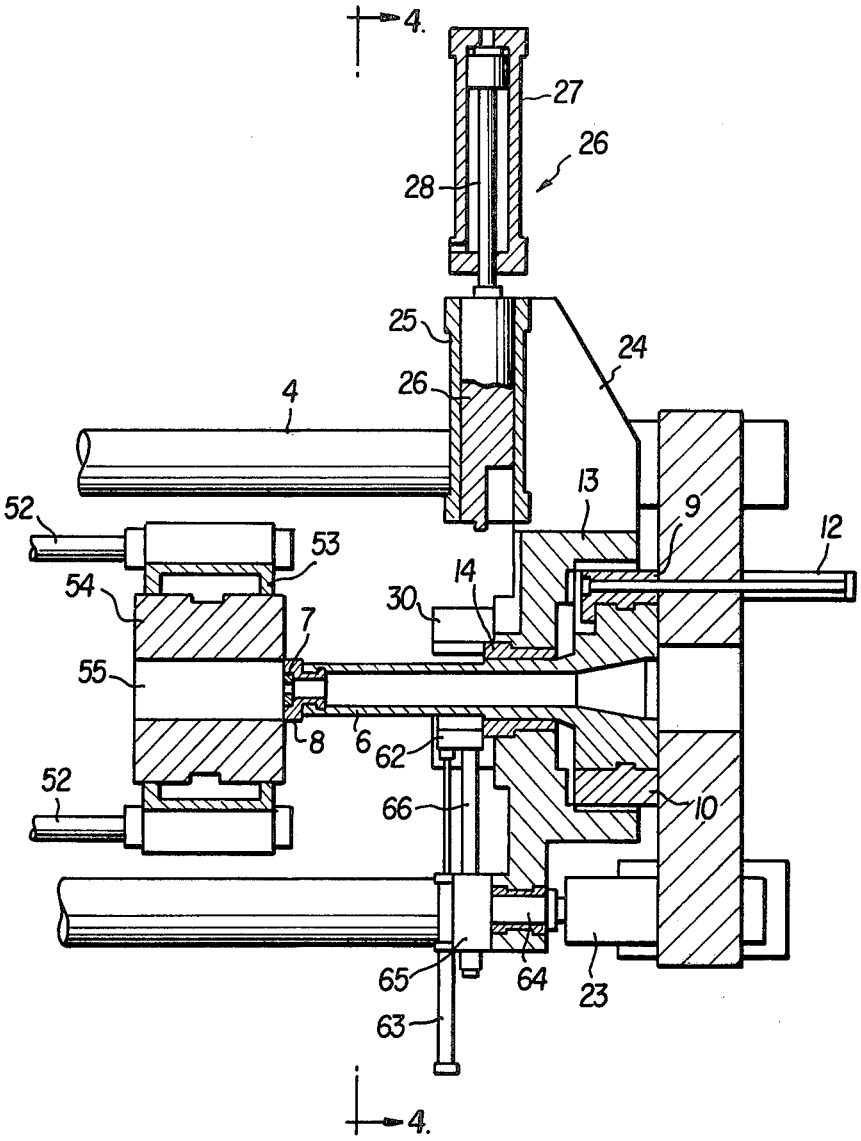
FIG. 3 is a side sectional view of the principal portion when a discard receiver and the like are attached to the intermediate frame.

FIGS. 3 and 4 show an embodiment wherein discard treating means are connected to the intermediate frame 13. The discard treating means comprises a trough-shaped receiver 62 fitted to the piston end of a cylinder device 63, and a block 65 is disposed on the rear end surface of the intermediate frame 13 so as to rotate around a transverse support shaft 64. The cylinder device 63 is fitted to this block 65. A guide rod 66 extends from the block 65 toward the core axis of the press and a revolving cylinder device 68 is interposed between an arm 67 formed on the block 65 and the intermediate frame 13 so as to turn the whole treating means around the support shaft 64 by means of reciprocation of the cylinder device 68. Reference numeral 69 represents a chute which is provided at the lower position on the opposite side with respect to the revolving cylinder device 68. The receiver 62 advances towards the core axis of the press when the cylinder device 63 is extended and retracted away from the core axis when the cylinder device 63 is retracted. As shown in FIGS. 3 and 4, when the receiver 62 moves forward, the receiver 62 corresponds to the die stem 6 below the die.

Figure 7:
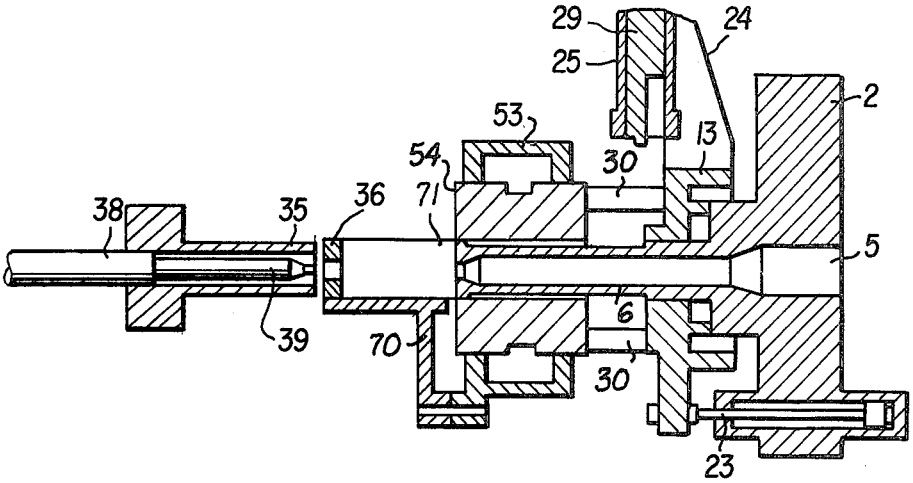
Figure 8:
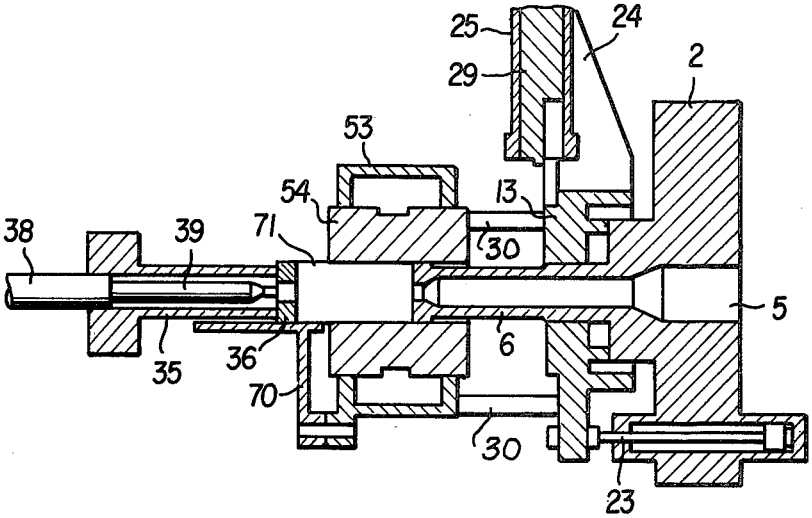

Next, explanation will be given on the operation cycle of the apparatus of the present invention by referring to FIGS. 7 through 12, wherein a billet loader 70 is contemplated as being positioned at the back of the container 54. FIG. 7 shows the billet supply state wherein the container 54 covers the die stem 6 and the billet loader 70 advances on the core axis of the press between the pressing stem 35 and the die stem 6 while it is revolving, thereby attaining the supply state of the billet 71 on the loader 70.

Next, the container 54 is moved backward due to retraction of the container moving cylinder 56, and the billet 71 is gradually inserted into the billet storing chamber as shown in FIG. 7.

Figure 9:
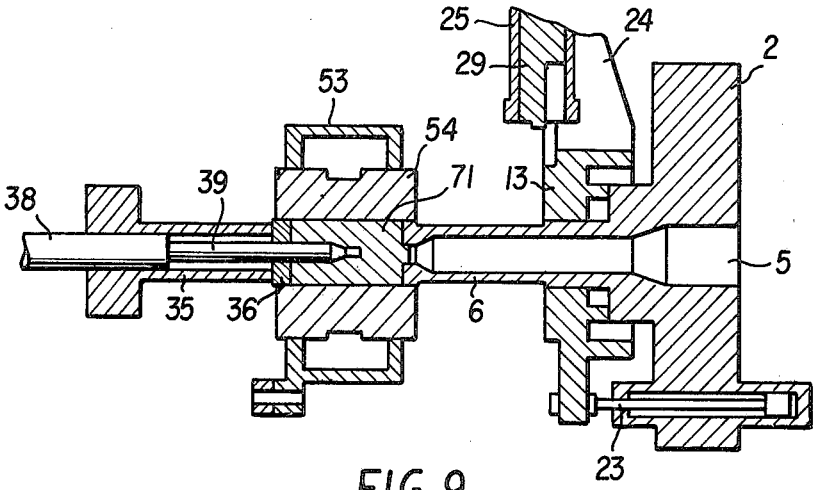

The drawing illustrates the condition wherein a tubular product is extruded after the billet 71 is perfectly inserted. First, the billet 71 is upset by the pressing stem 35 via the push table or dummy block 36 and the mandrel 39 is then caused to advance by the mandrel moving cylinder. Piercing is applied as shown in FIG. 9 and the tip of the mandrel 39 is faced the die aperture of the die 7, thereby determining the outer diameter of the product by the die 7 and its inner diameter by the mandrel 39.

Figure 10:
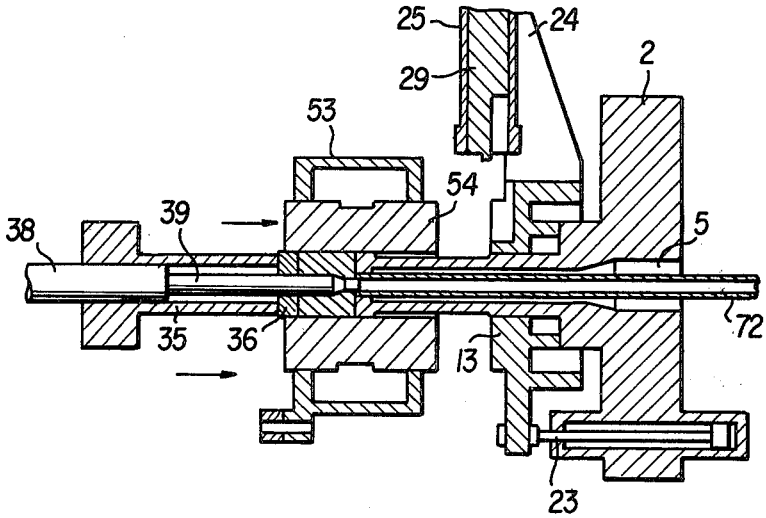

Next, the cylinder device for the pressing stem 35 and the cylinder device for the container 54 are applied with the pressure oil in order to simultaneously advance the stem and the container without causing relative deviation of the position between them. Thus, the product 72 is indirectly extruded as shown in FIG. 10. In this instance, the total capacity of the press is applied as a load to the die stem 6.

At this time the die stem 6 is guided and supported by the guide ring 14 disposed on the intermediate frame 13 and strongly held with respect to the press platen 2 by the locking effect of the tension bolt 12 in cooperation with the hydraulic jack 11. During extrusion, therefore, it is possible to enlarge the holding length $L_2$ relative to the effective length $L_1$ (see FIG. 1) of the die stem 6, thereby ensuring the high accuracy of the die stem 6. The press capacity becomes great, especially since the billet 7 is cooled and push-clogging occurs, but this can effectively be coped with by the abovementioned arrangement.

Figure 11:
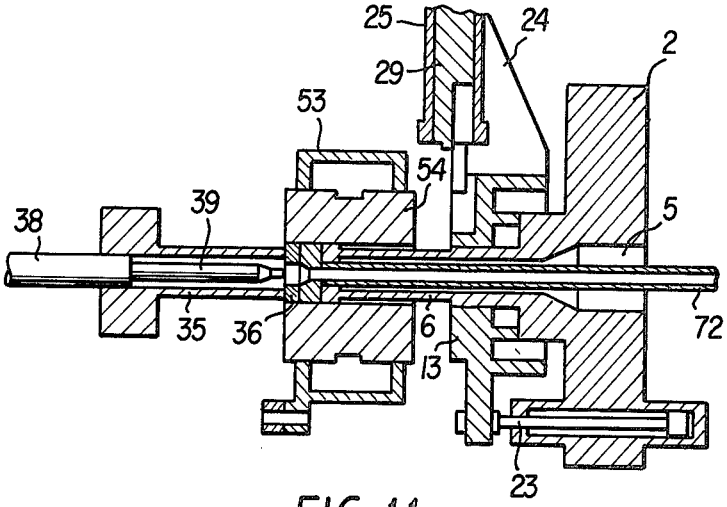

After the indirect extrusion is completed in this manner, the container 54 is caused to retract as shown in FIG. 11 and the push table 36 as well as the discard are moved in front of the container. Next, the intermediate frame 13 is simultaneously advanced towards the container 54 by the extension of the cylinder device as its driving device 23.

During this movement, it is possible to secure the sufficiently long guide because the slide shoe 61 is brought into frictional and sliding contact with, and guided by, the press structure having the rigid frame structure such as the liner 60 of the bed 1, for example. Particularly because the guide surface uses the bed 1, the ram 4, etc. as its reference surface, it is possible to ensure high accuracy free from core deviation. The intermediate frame 13 is caused to move until its stopper 30 abuts with the front surface of the container 54 and defines a sufficient gap required for the shear 29 to come thereinto between the container 54 and the intermediate frame 13.

Figure 12:
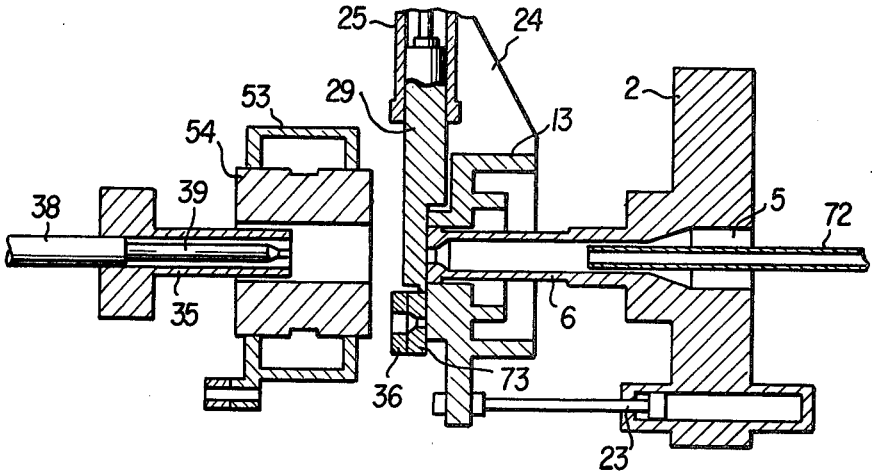

After the shear 29 is moved past the stopper 30 and between the container 34 and the rear end surface of the die stem 6, the shear cylinder device 26 is extended whereby the shear 29 advances towards the core axis of the press as shown in FIG. 12 and cuts or engages both the push table 36 and the discarded portion 73. Though this shear force acts on the die stem 6 as a large bending moment, the die stem 6 is free from the core deviation, deformation and the like because its free end is supported by the guide ring 14 of the intermediate frame 13 and the press platen 2 is held by the tension bolt 12 in cooperation with the hydraulic jack 11, and particularly because the intermediate frame 13 is supported by the guide means 58, it sufficiently reinforces the shear force and guarantees maintenance of the accuracy of the die stem 6.

After the push table 36 and the press discarded portion 73 are integrally cut off from the product 72, they are received by the receiver 62 in the embodiment shown in FIGS. 3 and 4, and are taken out to the chute 69 by the extension of the revolving cylinder device 68. After passing through the cutting step of the discarded portion 73 and the product 72, each member is positioned as shown in FIG. 7, thereby completing one press cycle. Furthermore, the intermediate frame 13 is returned to its original position by the retraction of the moving cylinder 23.

Figure 13:
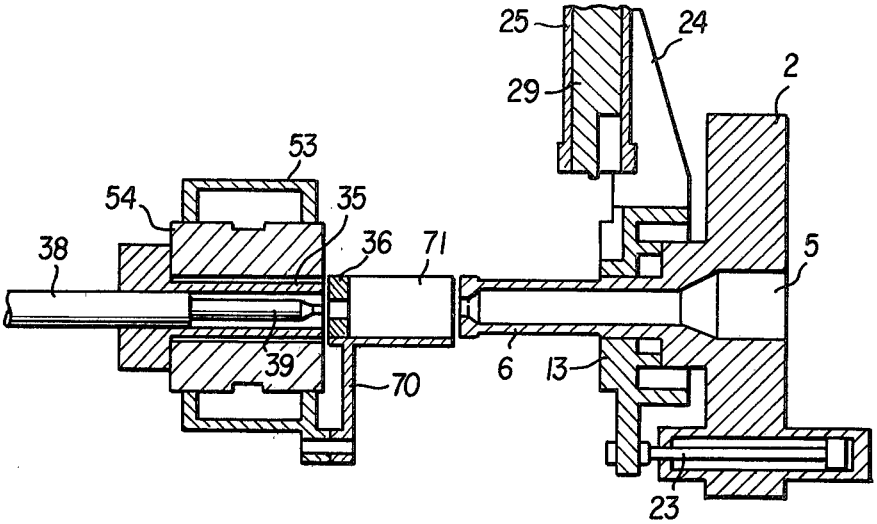
Figure 14:
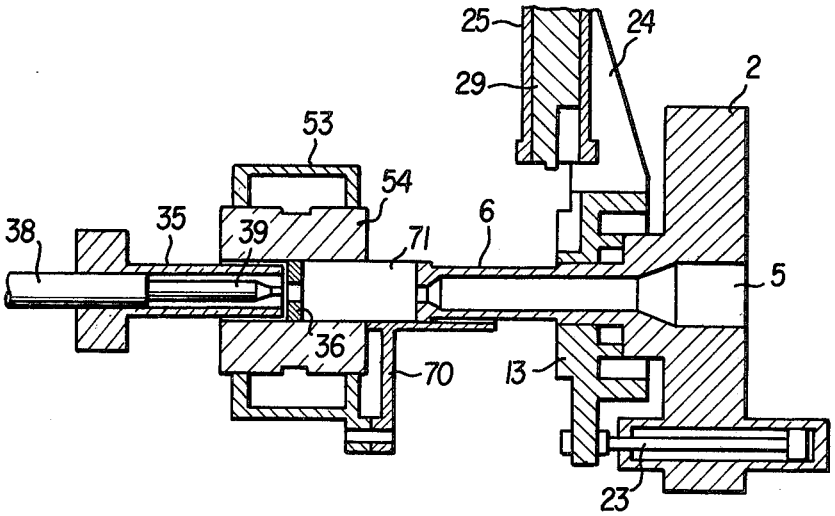

FIGS. 13 and 14 shown an embodiment wherein the billet loader 70 is disposed in front of the container. This embodiment is different from the abovementioned embodiment only in that the actions of billet supply and insertion are different.

Figure 15:
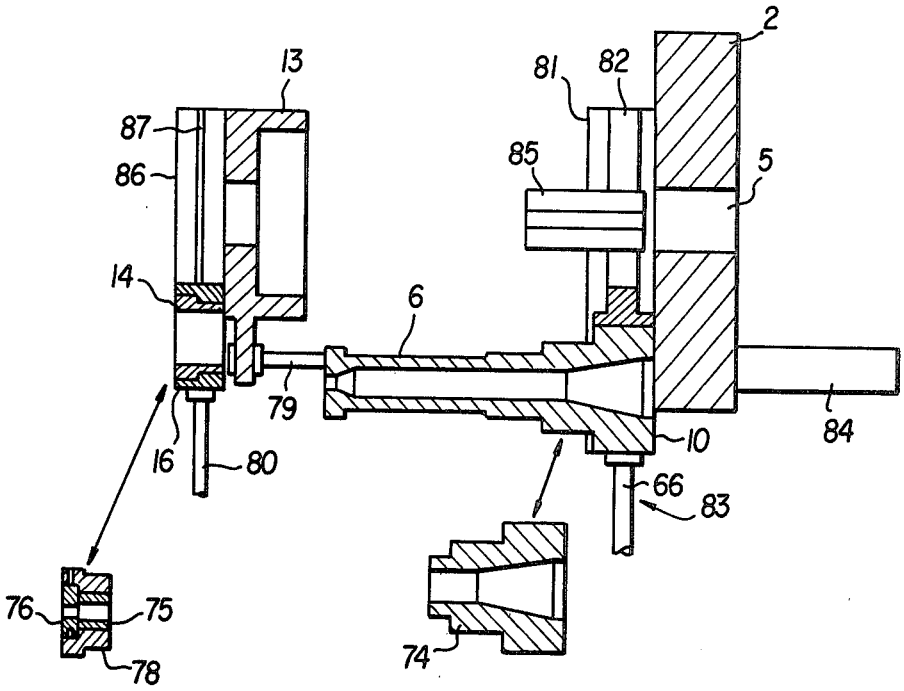
FIG. 15 is a side sectional view of another embodiment of the present invention.

FIG. 15 shows another embodiment of the present invention wherein reference numeral 83 represents die stem driving means. The drawing shows only the guide rod 66 which is disposed on the side of the press platen 2 via the cylinder support. The end of this guide rod 66 is connected to the die stem slide 10. In the drawing, the die stem 6 is moved from the center to the outside of the press by the retraction of the guide rod 66. A trough 85 is provided so that it is located at the press center when the die stem 6 is situated outside the press by the retraction of the guide rod 66. Reference numeral 86 represents a guide surface and 87 denotes a rugged engaging section.

The intermediate frame 13 has an annular shape capable of encompassing the die stem 6 located at the press center and is equipped with a pair of slide shoes 61 at the lower portion both on the right and left as shown in FIG. 2. In the embodiment shown, the intermediate frame 13 is brought into sliding contact with a pair of right and left liners 60 and is capable of moving freely in the press axis direction.

The die stem 6 is moved outside the press center as it is guided by a guide section 82 of a die stem guide member 81. By removing the fitting section of the die stem 6, a die bolster 74 of a direct extrusion press is fitted in place of it. On the other hand, the moving frame of the intermediate frame 13 is caused to move by the extension of its driving means so that the guide ring 14 is moved outside the press from the press center and is removed from the fitting section 15 of guide 16. Instead of the guide ring 14, a die holder 78 incorporating a die 76 for direct extrusion and a die backer 75 is also fitted to the fitting section 15 outside the press. In this manner, in accordance with the indirect extrusion press of the present invention, there are obtained the advantages that the indirect extrusion press can be used relatively easily also as a direct extrusion press and that the shear device may be used for the purpose of separating the product from the portion to be discarded.

Figure 16:
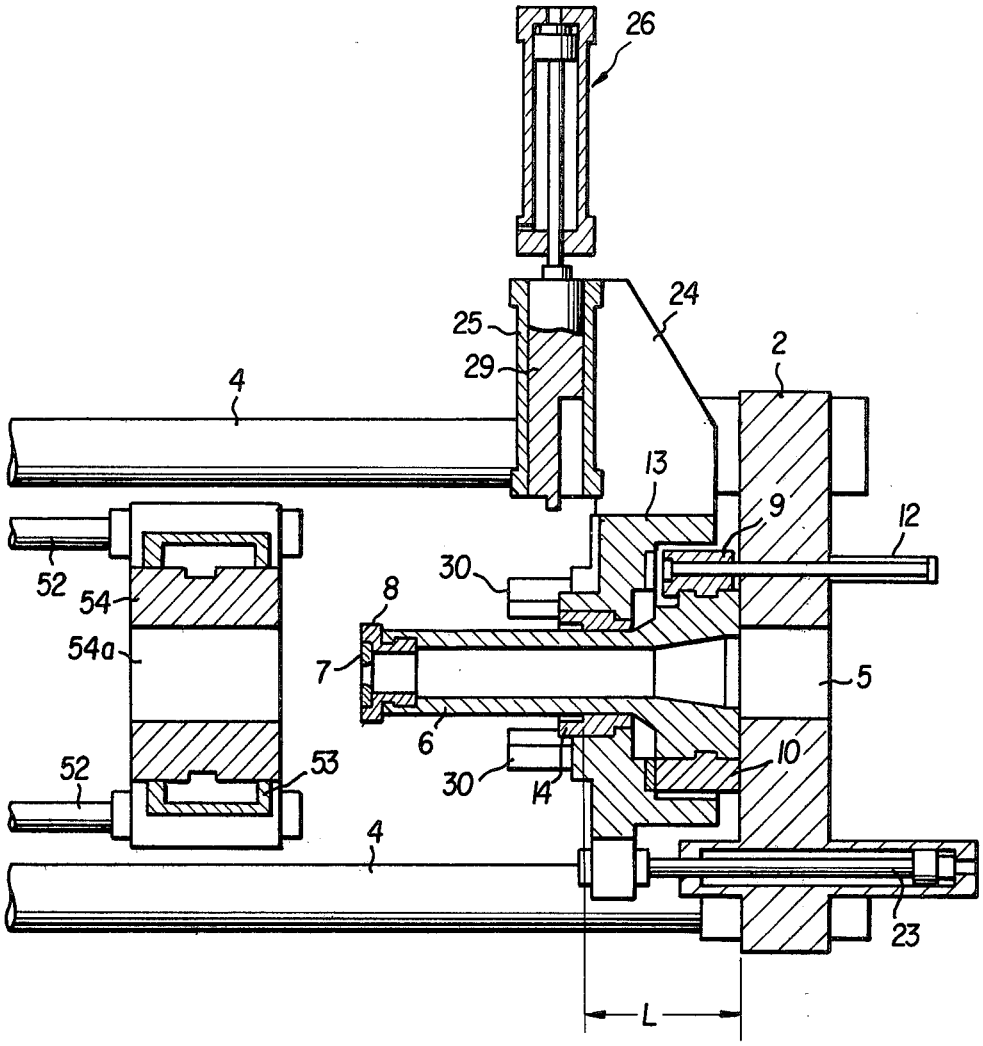
FIG. 16 is a sectional view of the principal portion of still another embodiment of the present invention.

FIG. 16 shows the principal portion of still another embodiment of the present invention wherein the guide ring 14 supports the center portion of the die stem 6. After the extrusion is completed, the intermediate frame 13 is caused to move backward by the extension of the cylinder device 23 so as to support the outer circumferential surface of the die holder 8 by means of the guide ring 14. On the other hand, the extrusion step shown in FIGS. 7 through 12, a hollow article as the product is shown extrusion-molded. Though the extrusion capacity is applied as a load to the die stem 6, it can sufficiently cope with the extrusion capacity to thereby guarantee the accuracy because the root section of the die stem 6 is strongly secured by the press platen 2 and moreover, the guide ring 14 provided to the intermediate frame 13 holds the center in the longitudinal direction of the die stem, thus enlarging the support length L of the die stem 6.

At the time of cutting off the product from the portion to be discarded after completion of the extrusion, the shear force also acts on the die stem 6. However, since the rear end portion of the die stem 6 is supported by the guide ring 14, the die stem exhibits sufficient back-up action against the shear force and is thus free from the deformation, core deviation and the like of the die stem 6.

Figure 17:
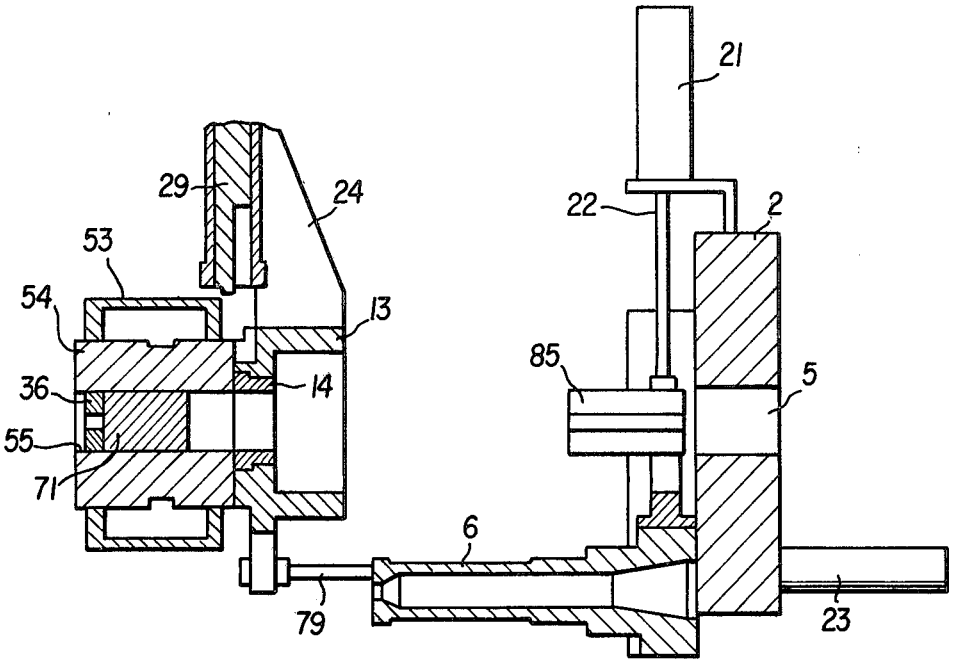
FIG. 17 is a cross-sectional plan view of the processing steps of the pierced billet in the extrusion press of the present invention.
Figure 18:
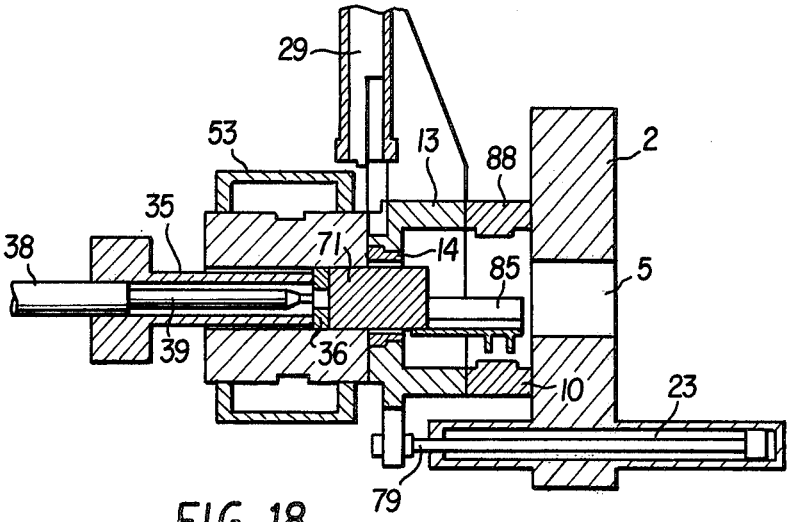
FIG. 18 is a longitudinal sectional side view of the processing step of the pierced billet in the extrusion press of the present invention.

FIGS. 17 and 18 show the treating step of the stuffed billet. The die stem slide is locked to the die stem slide guide 88 by the hydraulic jack in cooperation with the tension bolt. After this locking is released, the die stem slide cylinder 21 is caused to extend whereby the die stem 6 moves outside the press together with the die stem slide in the direction at right angles to the press direction via the guide of the guide surface. Due to the movement of the die stem 6 outside the press, the trough 85 moves towards the center of the press, thereby attaining the state of operation as shown in FIG. 17. Thereafter, the intermediate frame 13 is caused to advance by means of retraction of its moving means 23 so that its front surface abuts with the rear surface of the die stem slide guide 88, and the container 54 is also advanced so that its front surface abuts with the rear surface of the intermediate frame 13.

This state of operation is shown in FIG. 18. As the pressing stem 35 is advanced via the main ram and the like, the stuffed billet inside the container 54 is projected into the trough 85 waiting at the press center. In this instance, the stuffed billet 71 and the container are strongly secured to each other. Though the press capacity acts on the container 54 due to this friction, the press capacity is borne by the press platen 2 having the rigid frame structure consisting of the intermediate frame 13 and the die stem guide 88. In consequence, the stuffed billet 71 is projected smoothly and reliably into the trough 85.

After the stuffed billet 71 is projected into the trough 85, the intermediate frame 13, the container 54, the pressing stem 35, etc. are caused to return to their respective positions. When the driving means 21 for the die stem slide guide 88 is then actuated to extend, the trough 85 moves outside the press from the press center and at the same time, the die stem 6 comes into the press center. During the period in which the die stem 6 is again locked, the stuffed billet 71 on the trough 85 is withdrawn outside the press. Incidentally, the stuffed billet may be withdrawn while the front end surface of the intermediate frame butts on the rear end surface of the press platen.

Accordingly, it is possible to automatically take out the stuffed billet outside the press and moreover, its treating time can be advantageously shortened.

Obviously, many modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. In an indirect extrusion press of the type having a cross head, a ram, a pressing stem, a die, a shearing means, and a frame including a press bed and columns, and wherein a die stem is connected along a press axis on the rear end surface of a press platen and extends toward a container, an intermediate frame type indirect extrusion press which comprises:

an intermediate frame mounted on said frame, and movably interposed in the direction of the press axis between said press platen and said container;

guide means disposed between said intermediate frame and said frame for guiding said intermediate frame in a direction parallel to the direction of the press axis;

die stem support means carried by the intermediate frame and engageable with the die stem for providing support thereto; and a driving device for moving said intermediate frame in the direction of the press axis whereby the movable intermediate frame and die stem guide means carried thereby can be moved along the die stem to provide support thereto and maintain accurate alignment of the die stem during extrusion and shearing operations.

2. The indirect extrusion press as defined in claim 1, which further comprises:

a die stem guide member secured to said press platen and having a guide section in a direction at a right angle to the direction of the press axis;

a die stem clamp wherein said die stem is selectively movable with respect to said guide member or fixedly secured to the press center of said press platen via said die stem clamp;

driving means for releasing the die stem clamp;

driving means for moving said die stem between the press center and the outside of said press;

a shearing device connected to said intermediate frame;

means for moving said shearing device in a direction at a right angle to the press axis;

said die stem support means being movable in a direction at a right angle to the press axis and including a detachable die stem guide ring; and driving means for moving said die stem support means in the direction at a right angle to the press direction between the press center and the outside of said press.

3. The intermediate frame type indirect extrusion press as defined in claim 6, which further comprises:

a shearing device connected with said press platen for cutting an extruded product from a portion of material to be discarded; and said die stem support means interposed between the die stem and intermediate frame for guiding said die stem in the press axis direction, to engage and support a central portion of the die stem in the longitudinal direction of said die stem during cut-off of said portion of material to be discarded.

4. The intermediate frame type indirect extrusion press as defined in claim 3, wherein the die stem support means comprises a guide ring carried by the intermediate frame and slidably encircling the die stem.

5. The intermediate frame type indirect extrusion press as defined in claim 1, which further comprises:

a die stem guide member disposed on the rear end surface of said press platen and including a slide surface in a direction at a right angle to the press center, said die stem being slidable on the slide surface;

die stem driving means for selectably moving and securing said die stem between the press center and a position spaced apart therefrom;

said die stem support means being movably positioned adjacent the intermediate frame for guiding the die stem and being removable for replacement with a die and die backer for use with the die bolster in direct extrusion prosesses;

a trough retractably movable to and from the press center when said die stem moves outside said press;

a main ram connected to said press bed; and a stuffed billet treating device for abutting the front surface of said intermediate frame on the rear surface of said die stem guide member when a billet is stuffed into said container while said trough is in a first operational condition at the press center and for allowing said billet to be stuffed in said container and onto said trough by said main ram.

6. In an indirect extrusion press of the type having a cross head, a ram, a pressing stem, a die, and a frame including a press bed and columns, and wherein a die stem is connected along a press axis on the rear end surface of a press platen and extends toward a container, an intermediate frame type indirect extrusion press which comprises:

an intermediate frame mounted on said frame and movably interposed in the direction of the press axis between said press platen and said container;

guide means disposed between said intermediate frame and said frame for guiding said intermediate frame in a direction parallel to the direction of the press axis;

die stem support means carried by the intermediate frame for providing support to the die stem;

a driving device connected to said intermediate frame for moving said intermediate frame in the direction of the press axis;

a shearing device movably mounted on said intermediate frame for movement in a direction at a right angle to the direction of the press axis for the purpose of cutting off a portion of material to be discarded; and a stopper disposed on said intermediate frame on the side thereof toward said container to define a gap for entrance of said shearing device thereinto between said intermediate frame and said container, said movable intermediate frame and die stem guide means providing support to the die stem during extrusion and shearing operations.

* * * * *

UNITED STATES PATENT AND TRADEMARK OFFICE

CERTIFICATE OF CORRECTION

PATENT NO. : 4,365,497

DATED : December 28, 1982

INVENTOR(S) : AKIRA ASAHI

It is certified that error appears in the above-identified patent and that said Letters Patent is hereby corrected as shown below:

Column 1, line 14, before "the direction" delete "of" and insert --in--;

Column 1, line 15, delete "storing" and insert --strong--;

Column 1, lines 58-59, after "from the" insert --portion to be--;

Column 2, line 51, delete "furnished" and insert --connected--;

Column 2, line 51, delete "said" and insert --the--;

Column 3, line 5, delete "said" and insert --the--;

Column 4, line 17, before "spaced" insert --be--;

UNITED STATES PATENT AND TRADEMARK OFFICE

CERTIFICATE OF CORRECTION

PATENT NO. : 4,365,497

DATED : December 28, 1982

INVENTOR(S) : AKIRA ASAHI

It is certified that error appears in the above-identified patent and that said Letters Patent is hereby corrected as shown below:

Column 6, line 8, after "cylinder 56" delete "provided" and insert --connected--;

Column 6, line 22, after "shoes 61" delete "provided" and insert --connected--;

Column 7, line 33, delete "push table" and insert --pressed sheet--;

Column 8, line 10, delete "shown" and insert --show--;

Column 10, line 45, delete "6" after "claim" and insert --1--;

Column 11, line 6, delete "prosesses" and insert --processes--.

Signed and Sealed this

*Twenty-first* Day of *June 1983*

[SEAL]

*Attest:*

DONALD J. QUIGG

*Attesting Officer*

*Acting Commissioner of Patents and Trademarks*